US007140161B2

(12) United States Patent
Till

(10) Patent No.: US 7,140,161 B2
(45) Date of Patent: Nov. 28, 2006

(54) BEVERAGE BOTTLING PLANT FOR FILLING BOTTLES WITH A LIQUID BEVERAGE FILLING MATERIAL, HAVING CONTAINER HANDLING MACHINES WITH CARRYING POCKETS

(75) Inventor: Volker Till, Hofheim/Taunus (DE)

(73) Assignee: KHS Maschinen-UND Anlagenbau AG, Dortmund (DE)

( * ) Notice: Subject to any disclaimer, the term of this patent is extended or adjusted under 35 U.S.C. 154(b) by 85 days.

(21) Appl. No.: 10/967,016

(22) Filed: Oct. 15, 2004

(65) Prior Publication Data

US 2005/0108987 A1 May 26, 2005

(30) Foreign Application Priority Data

Oct. 18, 2003 (DE) ..... 103 48 531

(51) Int. Cl.
*B65B 55/04* (2006.01)
*B65B 7/28* (2006.01)

(52) U.S. Cl. ..... 53/167; 53/276; 53/300; 53/317

(58) Field of Classification Search ..... 53/276, 53/277, 278, 300, 317, 167; 198/441, 470.1
See application file for complete search history.

(56) References Cited

U.S. PATENT DOCUMENTS 4,467,908 A * 8/1984 Schneider ..... 198/441
5,671,585 A * 9/1997 Peronek et al. ..... 53/300
5,713,403 A * 2/1998 Clusserath et al. ..... 141/101
5,816,029 A * 10/1998 Sweeny ..... 53/317
6,354,427 B1 * 3/2002 Pickel et al. ..... 198/470.1
6,436,330 B1 * 8/2002 Winter ..... 425/500
6,698,160 B1 * 3/2004 Peronek et al. ..... 53/317
6,834,478 B1 * 12/2004 Peronek et al. ..... 53/317

FOREIGN PATENT DOCUMENTS

DE 103 26 618 A1 1/2005
DE 103 40 365 A1 3/2005

* cited by examiner

*Primary Examiner*—Louis Huynh
(74) *Attorney, Agent, or Firm*—Nils H. Ljungman & Associates

(57) ABSTRACT

A beverage bottling plant for filling bottles with a liquid beverage filling material, having a container handling machine such as, for example, filler, rinser, or closer for the processing of containers that comprise a neck ring, said machine comprising a rotating rotor (2) at which are disposed processing stations for the containers (6), with at least one input star (4), with at least one output star and/or at least one transfer star, with carrying pockets (5) that are disposed at the rotor (2) and/or the stars and it being disclosed that the processing stations are disposed on a reference diameter that is smaller than the rotor (2) related reference diameter of the transfer point of the container (6) between rotor (2) and input star and/or output star (4) and/or transfer star.

20 Claims, 13 Drawing Sheets

SECTION A-A IN FIG. 6A

SECTION B-B
IN FIG. 6A

FIG. 7
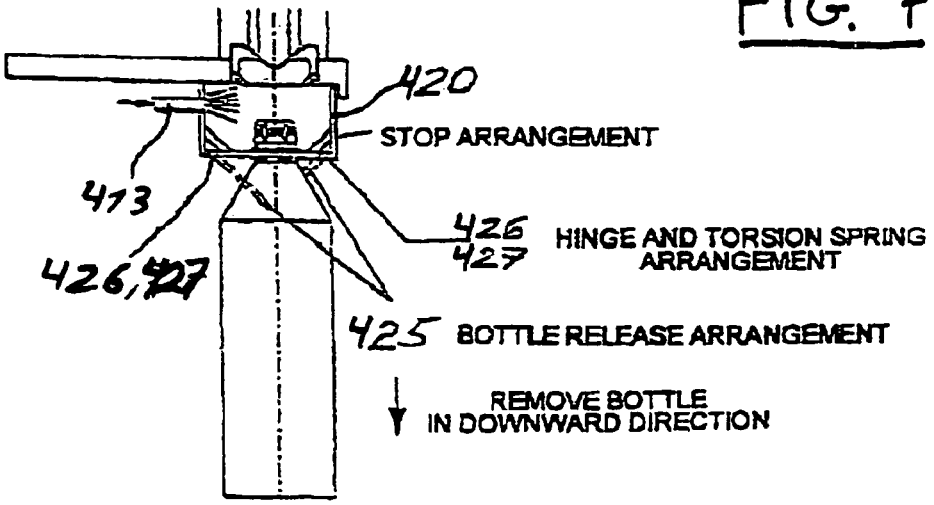
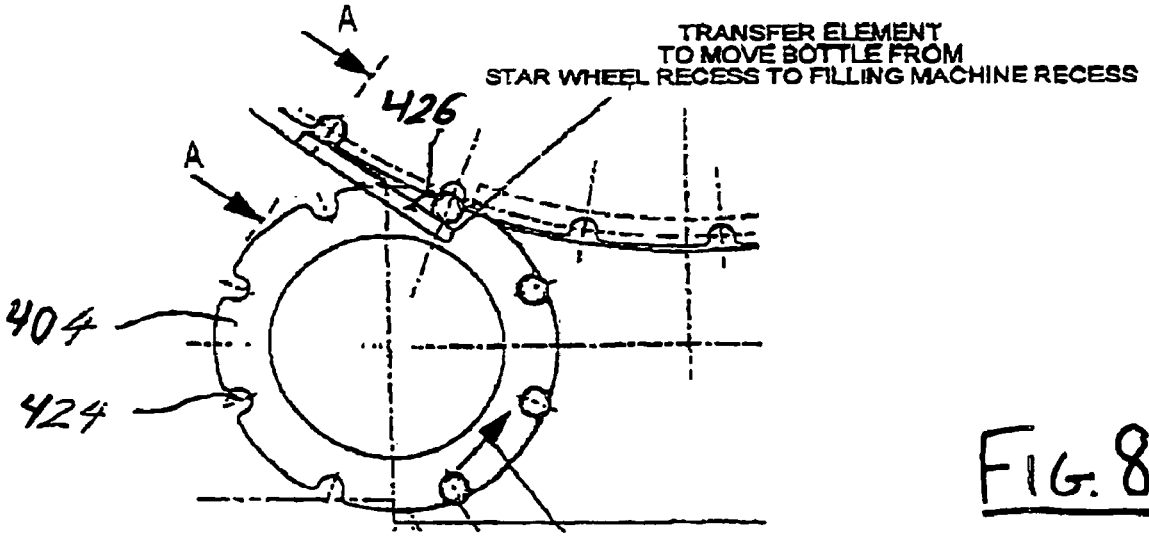
FIG. 8

SECTION A-A IN FIG. 8A

BEVERAGE BOTTLING PLANT FOR FILLING BOTTLES WITH A LIQUID BEVERAGE FILLING MATERIAL, HAVING CONTAINER HANDLING MACHINES WITH CARRYING POCKETS

BACKGROUND

1. Technical Field

The present application relates to beverage bottling plants for filling bottles with a liquid beverage filling material. The present application further relates to container handling machines that are configured with carrying pockets, said machines being of the art described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The container handling machines, equipped with carrying pockets, that are introduced in the framework of the application are primarily for the processing of containers made of, for example, PET, such as, for example, bottles that comprise a so-called collar ring or, respectively, neck ring. Furthermore, the application of the carrying pockets that are herein introduced is for all further suitable container types and also for further associated equipment and/or additional equipment, such as, for example, input stars and output stars.

Container handling machines are, for example, filling machines, closing machines, rinser and the like. For higher efficiency they are configured to be rotatable, with the container receiving processing stations being disposed at the perimeter of a so-called rotor and they carry the containers along during the processing.

Plastic containers comprising a neck ring are then handled and/or transported, when they are empty or when they are disposed within the handling machine, as a rule, by a so-called neck-handling.

The introduction of the containers into the handling machines, as a rule, is done by known arrangements for the materials handling using air for such containers. Within the processing machines the flow is carried out by transfer stars and/or transport stars that are particularly configured for the handling of containers that comprise a neck ring.

The transfer of the containers from the air materials handler, in which the containers are transported in random manner and without a fixed array, to the transfer stars or transport stars, that convey the containers in an orderly fashion and in a predetermined fixed array, is done using known input screws or separating screws that present the containers in an individual array, from initially being disposed in contact with one another during the transport by the air materials handler; and subsequently they are passed to an input star or a transport star.

The next step comprises the transfer of the container from an input star to the rotor of the processing machine.

The designs that are required for this object are predominantly determined by the manner in which the containers are fixed during transport by the rotor of the processing machines.

In the event that the containers are fixed, for example, by grippers that hold the mouth portions of these containers or, respectively, the neck rings, also, as a rule, the transfer stars or the input stars, comprise corresponding grippers, with the transfer of the containers from the input star to the rotor being carried out at an apparent contact point of both reference diameters. In this, the release by the input star and the fixing by the rotor are brought into conformity as to time and space in such a way that the transfer is done securely, rapidly, and error-free.

When the containers are fixed by grippers that secure the body of the container, the input stars generally do not comprise gripper elements, but so-called star pockets that are configured to initially guide the containers under utilization of outer guide arrangements and subsequently they are configured to transfer the containers to the grippers.

It is of disadvantage in the above-described installations that there is, firstly, a large amount of necessary components and also there arise associated high manufacturing costs and maintenance costs.

Particularly in the cold-aseptic filling that is gaining an ever increasing market share, there accordingly results for such installations a further essential disadvantage that resides therein that a larger effort needs to be expended so as to ensure the sterile treatment in a continuous operation.

For the solution, inter alia, of this problem the applicant has made further applications, such as, for example, file No. 103 40 365.5 and file No. 103 26 618.6, that deal primarily with cold-aseptic container handling machines and therein particularly with the reduction of the number of components and the reduction of the capacity of the required clean room or space.

A further problem of such cold-aseptic container handling machines comprises the consumption of sterile air and the costs associated therewith.

To provide solutions of the problem is also the aim of the above-mentioned applications of the applicant. Within the framework of these and other applications many problems have been solved. Essentially no concern has been shown for the losses of sterile air that occur at the point of separation between the rotating rotor of the container handling machine or the associated stars and the fixed enclosure.

The known configurations follow essentially the prior art illustrated in FIG. 1. These comprise carrying pockets at the input stars and output stars, and also at the rotors of the container handling machines, which receive the containers, with the containers being held at a portion of the necks that is disposed below the neck ring.

The known embodiments comprise carrying pockets which, as a rule, are configured in such a way that they embrace the container neck only up to its maximal diameter, in rare individual cases only a few millimeters beyond, or they can support them. Since this type of the carrying does not provide a secure guiding of the containers in such cases, outer guide arrangements are of necessity. In accordance with the present application these are configured, due to the design conditions at hand, in such a manner and they are disposed such that they contact the container neck at that side that is opposite to the carrying pocket and, in this way, urge the container accordingly into the carrying pocket or, respectively, fix the container therein.

When proceeding in this manner, a gap is established between the input stars or output stars, rotors and the outer guide arrangements associated with these components—which can be configured as enclosures or as complements of such—which gap has a width of approximately one half of the container diameter. For customary containers the relative neck diameter is, for example, 29 or 32 millimeters, so that the width of the gap is of the order of 14 or even 16 millimeters, this leading thereto that such container handling machines exhibit a high loss of sterile air.

With an increased demand for quality of the beverage to be filled into containers and its stability of durability, there is at hand a type of arrangement in which the handling positions are disposed in a closed space that is supplied with a special atmosphere. Such a space can be supplied with an inert atmosphere, for example, carbon dioxide, with a sterilizing atmosphere, or with hydrogen peroxide and thus can ensure a treatment of the beverage that is low in oxygen and low in germs, this being of paramount importance for the filling quality of the beverage. Such handling machines are known in many varieties in the beverage industry.

German Patent No. DE-PS 696,569 shows an arrangement in which a filling machine is disposed in a closed housing. The space that is provided in this manner is determined by the full size of the machine and has a substantial volume. German Patent Publication No. DE-OS 199 11 517 A1 shows a rotating filling machine that is fully disposed in a tightly surrounding housing that has a size that is determined by the size of the machine and, accordingly, the housing is also of substantial volume. German Patent No. DE-PS 198 35 369 C1 shows an embodiment in which the lower handling positions of container handling machines extend in sealed manner from above into a space that is supplied with a special atmosphere. This space is equipped so as to be accessed from below.

A further solution is disclosed in German Patent Publication No. DE-OS 197 31 796. The technical embodiment of this reference comprises a filling machine and a closing machine that are both disposed in a clean space or room that has a volume that is dimensioned so as to be so tight such that there is only space for maintenance at the filling machine and at the closing machine. By way of the reduction of the volume of the clean space, a lowering of the operating expense of the arrangement is to be attained. In addition, an immersion bath sterilizer is directly disposed at the clean space. This measure is to achieve, in contrast with European Patent No. EP 0120 789, to make the second rinser superfluous and to obviate associated operating and capital expenditures. This solution comprises overall the drawback that also in this embodiment there is suggested a clean space that fully envelops the filling machine, as well as the closing machine, and this arrangement requires a large amount of space and high construction and operating expenses. The desired extensive reduction in size of the constructive volume of the clean space that is sought in this teaching entails marked disadvantages, due to the diminished accessibility when maintenance is to be carried out.

The substantial volume of the space that is supplied with a special atmosphere is, accordingly, of disadvantage in the designs of the prior art. In the event of disruptions of operations, the space needs to be opened. It is then filled with normal ambient air and is correspondingly accessible to germs. The subsequent cleaning of the space prior to resumption of operations is largely determined by the surfaces and the overall volume of the space. In the case of the known large clean rooms, accordingly, the interruptions of operations, that are necessary due to disruptions of operations, or required relocation of machines, as well as the unavoidable cleaning of machines, last for hours.

From German Patent Publication No. DE-OS 101 45 803 A1 (corresponding to International Patent Publication No. WO 03/024860 A1, published on Mar. 27, 2003) and German Petty Patent No. DE-GM 297 13 155 U1, (corresponding to U.S. Pat. No. 6,026,867 issued to Karl on Feb. 22, 2000), it is finally known that the closed space is configured as an annular tunnel structure that moves about/or surrounds the carousel of the filling machine and the annular boiler, on the one hand, and by the stationary surfaces, on the other hand, whereby the carousel surfaces and the stationary surfaces are disposed in sealing manner atop one another or, respectively, with respect to one another by way of concentric seal elements. These known configurations already substantially reduce the required clean space.

OBJECT OR OBJECTS

It is the aim and object of the present application to provide an arrangement that assuredly precludes the above-mentioned disadvantages. For this, the present application refers to a container handling machine, input stars or output stars and transfer stars that are equipped with special carrying pockets, with the suggested arrangements being particularly applicable to container handling machines corresponding to the afore-mentioned applications, but not exclusively applicable to such container handling machines.

The special configuration of the carrying pockets makes it possible to realize a gap width that is near zero. Furthermore, there is achieved a very advantageous reduction of the reference diameter of the processing positions.

Such arrangements have not become known according to the knowledge of the applicant.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

In the following, the embodiments are further described in detail with reference to the drawing and embodiment examples.

As such, in the drawing:

FIG. 4B is a view similar to FIG. 4 drawn to a larger scale and including identification of further detail;

FIG. 7 illustrates a bottle unload arrangement for special cases that are caused by disruptions, along line A—A in FIG. 6;

DESCRIPTION OF EMBODIMENT OR EMBODIMENTS

Figure 1:
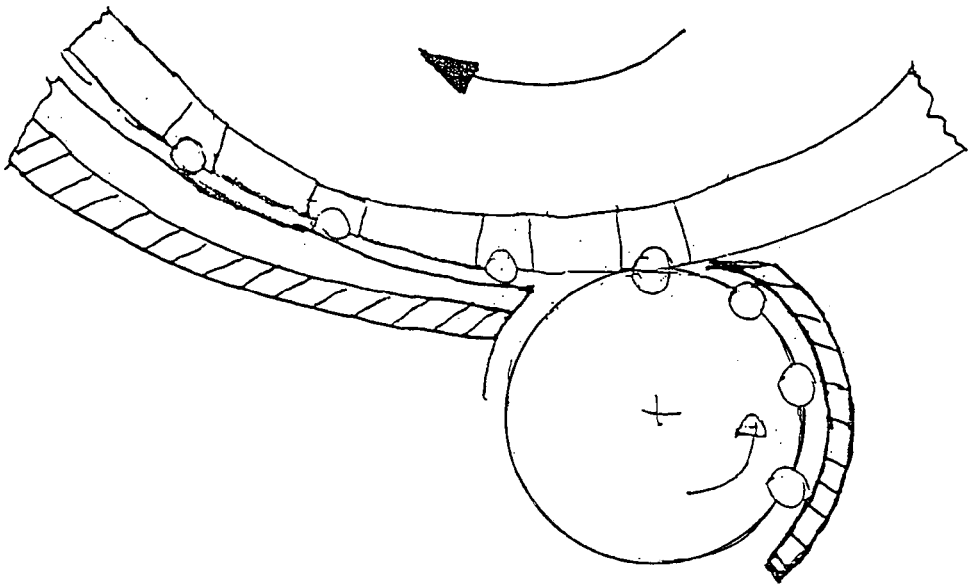
FIG. 1 PRIOR ART
FIG. 1 illustrates in two highly simplified lay-out drawings, firstly, a rotor that is part of the prior art of a container handling machine with a rotor, an outer guide arrangement that is configured as a housing, for the containers, an input star; and a second outer guide arrangement, that is associated with the input star, with the width of the gap being clear in this; Furthermore, there is shown a carrying pocket that is also part of the prior art.
Figure 1:
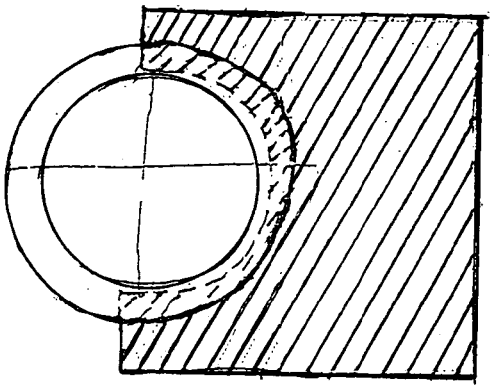
FIG. 1 PRIOR ART

Further development details, advantages and possibilities of application of the application can be obtained from the following description of embodiments and the drawing. With this, all described and/or illustrated features per se or in any combination, comprise the substance of the application, regardless of their combination in the claims or their dependency. At the same time, the content of the claims is made a component of the description.

Figure 1A:
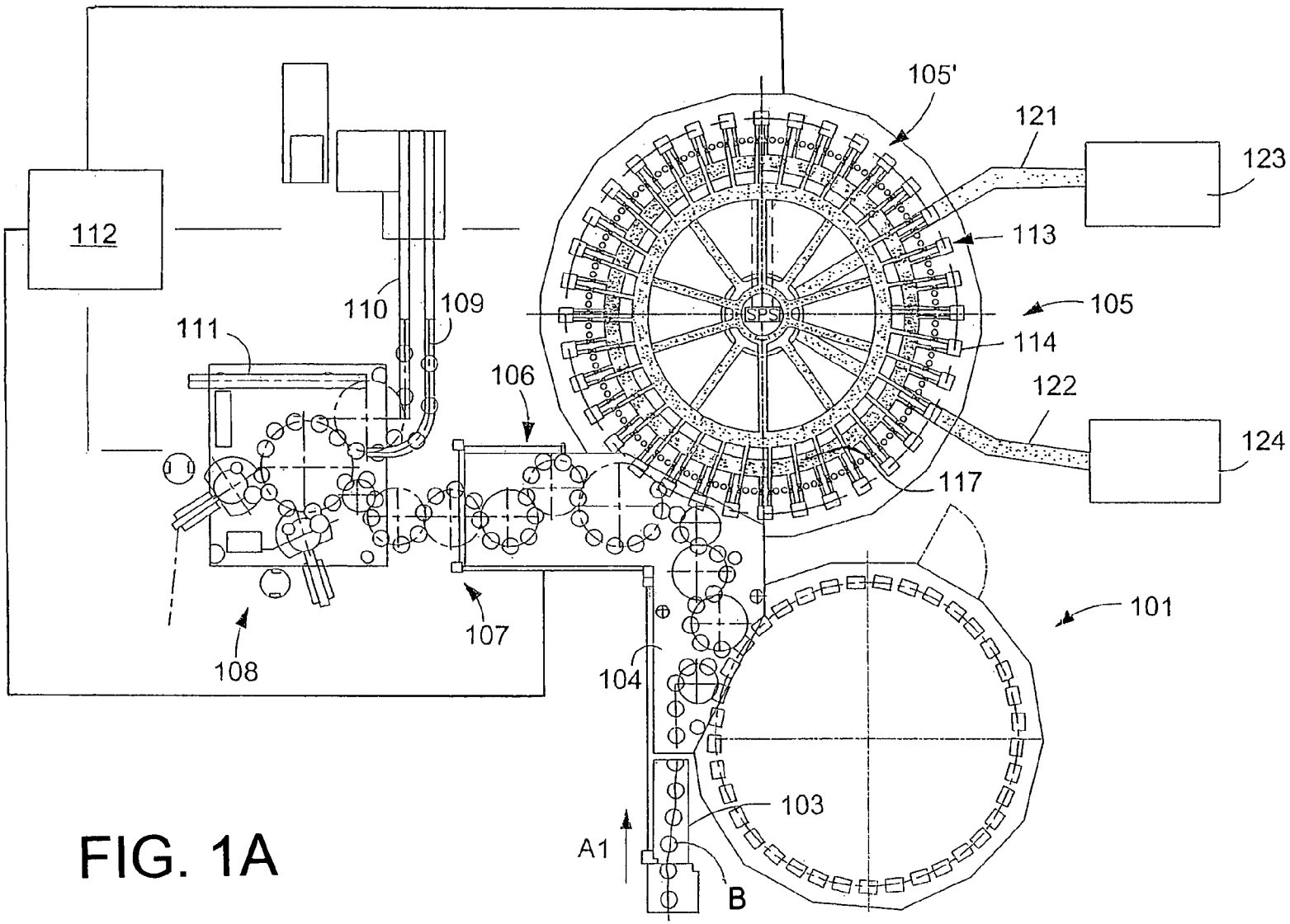
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely bottles B, are fed in the direction of travel as is indicated by the arrow A1, by means of a conveyer line or conveyer arrangement to feed bottles to rinsing arrangement 103, and downstream of rinsing arrangement or rinsing station 101, in the direction of travel as is indicated by the arrow A1, the rinsed bottles B are transported to a beverage filling machine 105 by means of a conveyer line or conveyer arrangement 104 to pass bottles to filling machine that is formed, for example, by a starwheel conveyer or a plurality of starwheels of a conveyer arrangement. The conveyer arrangement 104 to pass bottles to filling machine may possibly comprise a starwheel conveying structure that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product, each unit having a head, such as, for example, by means of a conveyer arrangement 107 to pass bottles to labeling arrangement that may be formed, for example, by a plurality of starwheels of a conveyer arrangement.

In the illustrated embodiment, the labeling arrangement or labeling station 108 having at least one labeling unit, device, or module for first product, each unit having a head has, for example, three outputs, namely one output formed by a conveyer arrangement 109 to convey first product bottles for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module in the labeling arrangement or labeling station 108 having at least one labeling unit, device, or module for first product, each unit having a head, corresponding to this first product delivered from first product mixer 123 to the beverage filling machine 105 and thence to the corresponding bottles B.

A second output that is formed by a conveyer arrangement 110 to convey second product bottles is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module in the labeling arrangement or labeling station 108 having at least one labeling unit, device, or module for first product, each unit having a head, corresponding to this second product.

A third output, for example, formed by a conveyer arrangement 111 to convey incorrectly labeled bottles, removes any bottles B which have been incorrectly labeled as may have been determined by an inspecting device or an inspecting station, or an inspecting module 128 that may possibly form a part of the labeling arrangement or labeling station 108 having at least one labeling unit, device, or module for first product, each unit having a head.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck. A filling arrangement 114 having at least one filling device, element, apparatus, or valve, comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product.

As well as the more typical filling machines having one toroidal vessel, it is possible that in at least one possible embodiment a filling machine could possibly be utilized wherein each filling arrangement 114 having at least one filling device, element, apparatus, or valve is preferably connected by means of two connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Figure 1B:
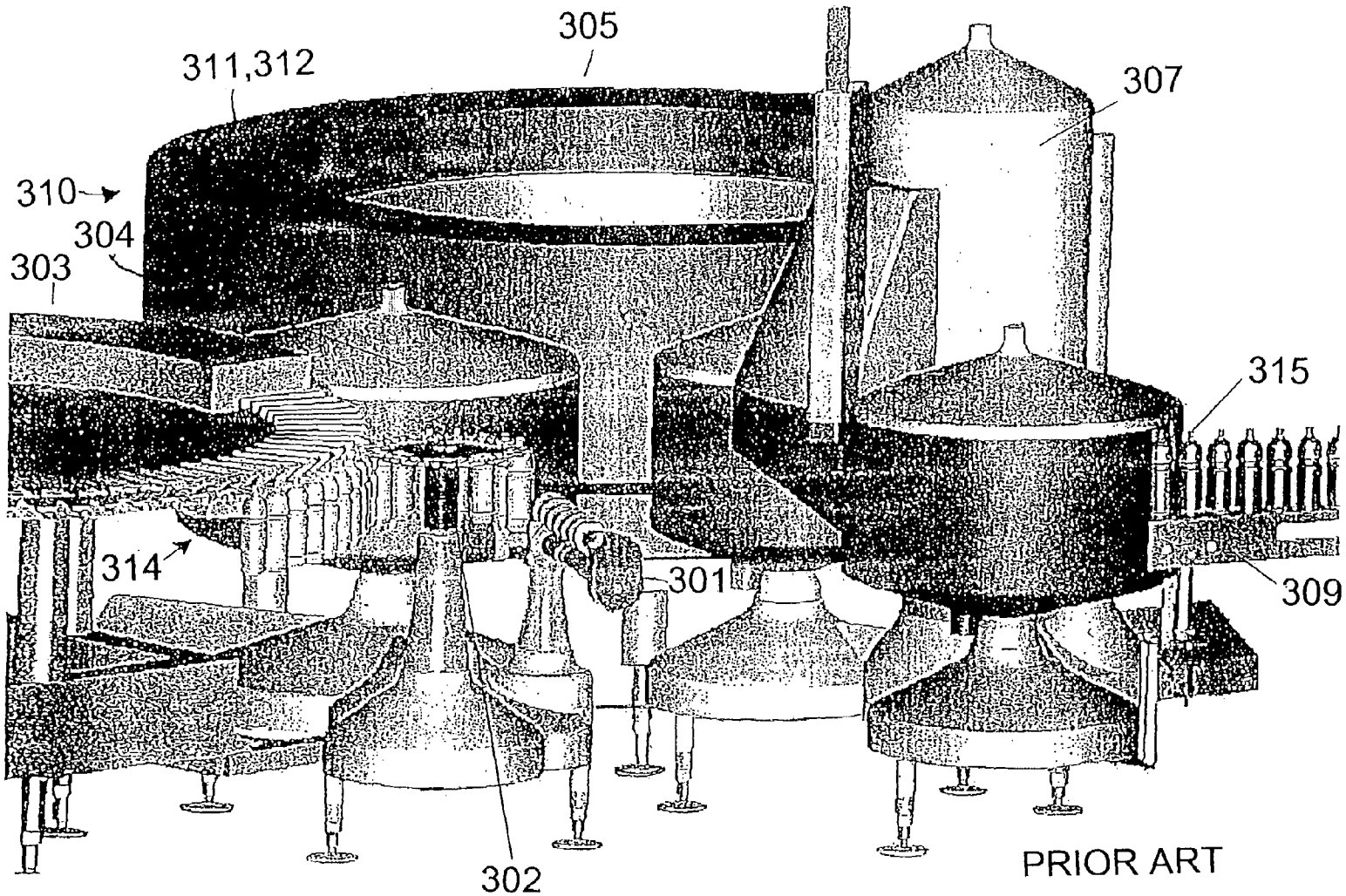
FIG. 1B is a perspective illustration of a state of the art machine arrangement for rinsing, filling, and closing of containers with a rotating annular chamber, partly shown as an exploded view.

FIG. 1B is a perspective illustration of a state of the art machine arrangement for rinsing, filling and closing of containers, for example, PET bottles (polyethylene terephthalate bottles).

Figure 1C:
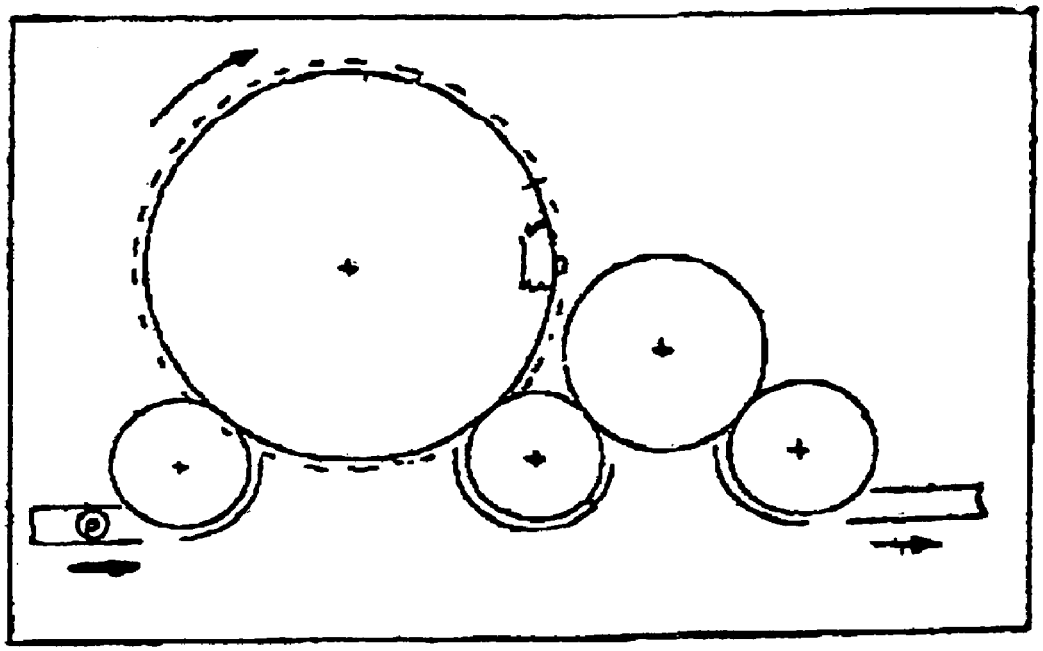
FIG. 1C shows a possible embodiment of a container handling machine with an aseptic filling system or a clean room, which aseptic filling system or clean room is represented by a box around the container handling machine.

FIG. 1C shows a possible embodiment of a container handling machine with an aseptic filling system or a clean room, which aseptic filling system or clean room is represented by a box around the container handling machine. In this possible embodiment, the aseptic filling system may encompass the entire container handling machine, or more than just the tops of the bottles.

FIG. 1 illustrates in two highly simplified lay-out drawings, firstly, a rotor that is part of the prior art of a container handling machine with a rotor, an outer guide arrangement that is configured as a housing, for the containers, an input star; and a second outer guide arrangement, that is associated with the input star, with the width of the gap being clear in this. Furthermore, there is shown a carrying pocket that is also part of the prior art.

Figure 2:
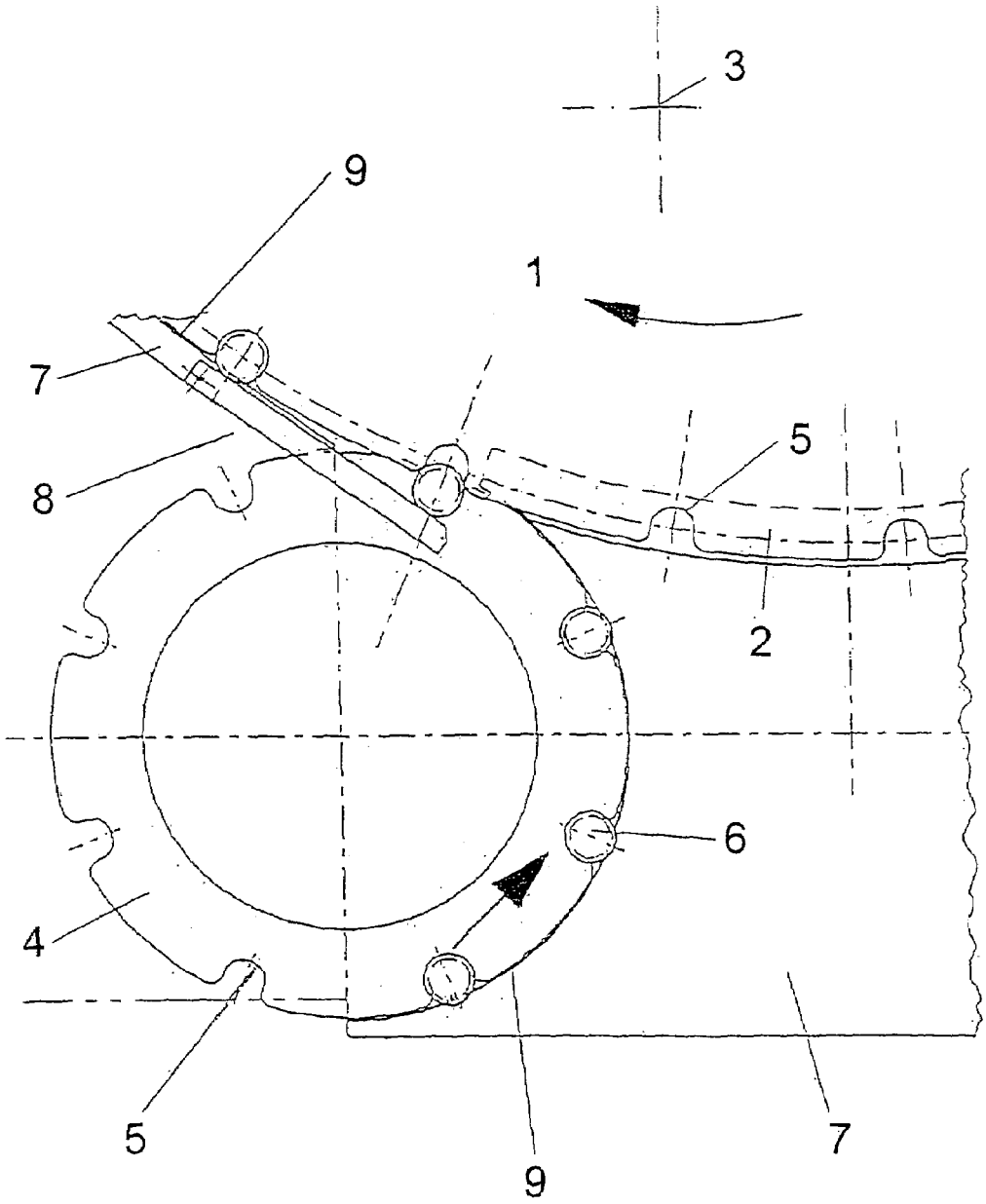
FIG. 2 shows in a simplified top plan view of an input star and a container handling machine, with these both comprising the carrying pockets in accordance with the present application.

FIG. 2, firstly shows a segment of a circle of the rotor 2 of a container handling machine 1, such machine comprising, for example, a rinser, but also a closer. The illustrated embodiment comprises a filling machine configured to be rotatable. The rotating portion of the filling machine, the so-called spinning rotor 2 is configured to rotate about the axis of rotation 3 of the machine.

By way of the input star 4, that is equipped with so-called carrying pockets 5, the containers 6 are passed to the container handling machine 1, with an outer guide arrangement 7 at least in part for a predetermined portion of the course of the containers 6 supporting the guiding of the containers 6 or, respectively, also carrying out the guiding of the containers 6. Provision is made to dispose an outer guide arrangement 7 also in the region of the rotor 2, where such a guide arrangement is necessary and/or useful.

The present application also relates to the configuration of the carrying pockets 5 and of the rotor 2 and to transfer stars and output stars. In order to simplify, with reference to the carrying pockets 5 of stars, in the following only input stars 4 or stars are discussed, these, of course, being representative for all types of stars.

The present application affords, because the carrying pockets 5 are configured in a particularly advantageous manner, that the size of the gap 9 that is established between the outer guide arrangement 7 and the rotor 2 or, respectively, the input star 4, is reduced to a small size that comprises only a few millimeters or even only fractions of millimeters.

In other words, the carrying pockets 5 are configured and disposed to receive the necks of bottles and to hold the necks of bottles, such that there is very little space between the surface of the neck of the bottles and the carrying pockets 5. Since there is such a minimal gap that exists between the surface of the bottles and the carrying pockets 5, very little sterile air may escape through this gap when bottles are transferred from the star wheel 4 to the rotor 5, or vice versa.

The considerable reduction of the size of the gap is particularly evident when comparing FIGS. 1 and 2 with one another.

The configuration of the carrying pockets 5 is done in such a way that the container neck of the container that is to be transported by the star or the rotor or to be carried by the star or rotor is fully, or substantially fully, carried by the carrying pocket 5.

The configuration in this manner affords that the outermost point of the container neck is configuring a point of the imaginary circumferential circle of the input star 4 or of the rotor 2, or extends beyond by a few one-tenths of a millimeter or also a few one-half of a millimeter beyond this imaginary circumferential circle.

Figure 2A:
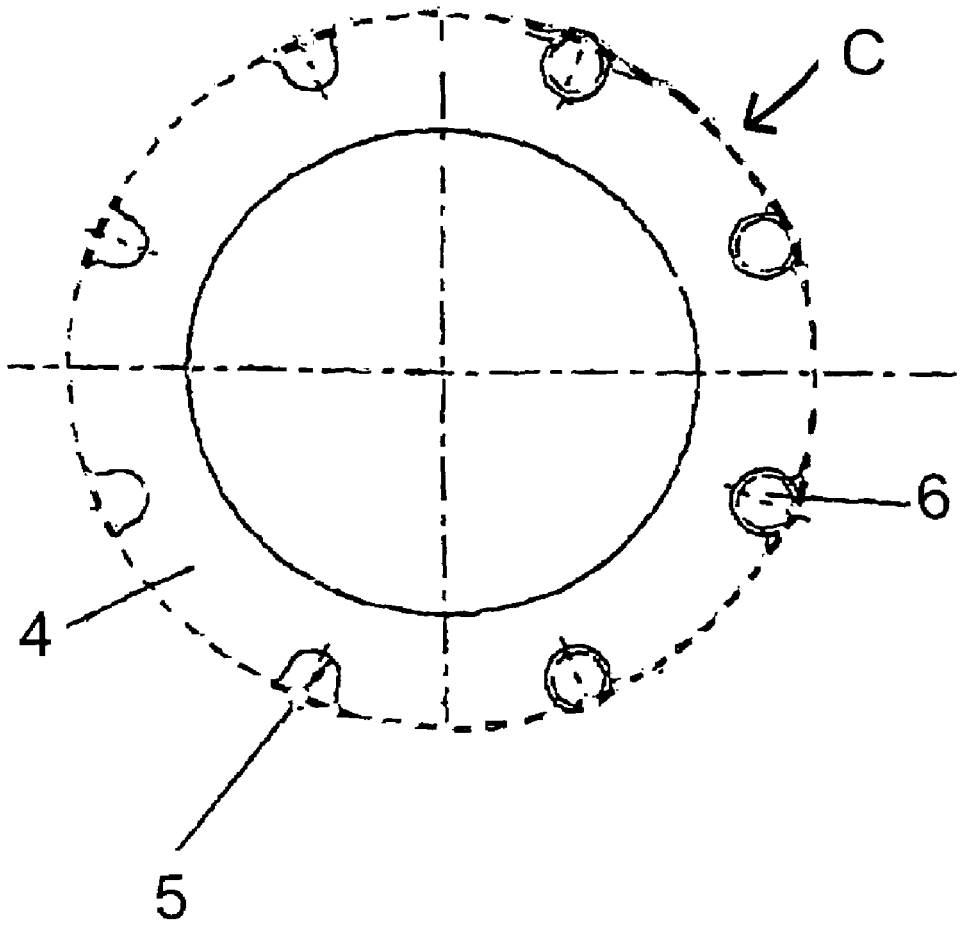
FIG. 2A shows an embodiment of a rotor with an imaginary circle with a circumference, which circle is shown along axis YZ.
Figure 3:
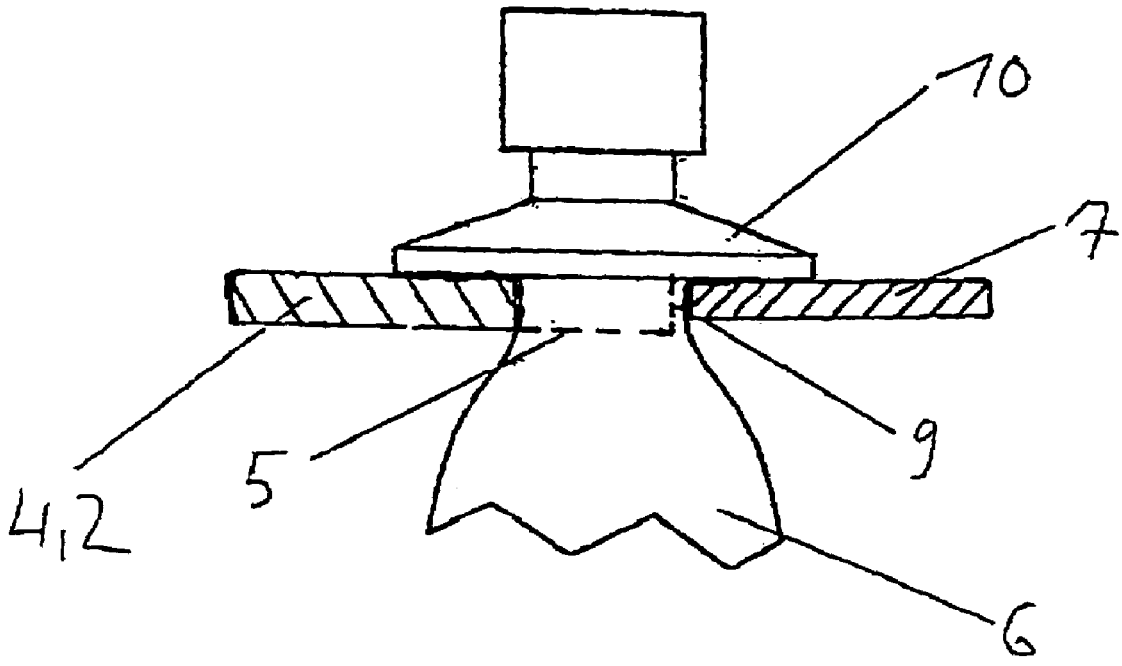
FIG. 3 shows in a simplified representation of an arrangement in accordance with the present application, with an embodiment being illustrated in which the container neck is not fully received by the carrying pocket 5.

In other words, the input star 4 and the rotor 2 each define reference circles having circumferences. For example, the reference circle Z for the input star 4 is illustrated in FIG. 2A. The perimeter edge of the reference circle Z runs along the outer edges of the input star 4 and extends across the carrying pockets 5. When bottles 6 are disposed in the carrying pockets 5, the outermost point of the surface of the neck of the bottle which is not in physical contact with the carrying pockets 5, that is, which faces the opening of the carrying pockets 5, lies a distance slightly beyond the perimeter edge of the reference circle Z, which distance could be, for example, a few one-tenths of a millimeter. Further, in an alternative embodiment, the edge of the neck of the bottle 6 may not extend beyond the perimeter edge of the reference circle Z, but rather lies on the perimeter edge of the reference circle Z.

The positioning of the container neck substantially establishes the width of the gap 9, it being desired that in order to reduce the consumption of sterile air, a rather small width of the gap 9 is provided. The smallest size that can be realized is unavoidably arising because of manufacturing tolerances and container tolerances in the event that the container neck is fully carried, these tolerances needing to be dealt with particularly between the rotating and stationary machine components.

The transfer of the containers 6 from the input star 4 to the rotor 2 is carried out with the assistance of the transfer arrangement 8.

The transfer is initially carried out by the containers 6 being urged against the transfer arrangement 8 by way of the continuously turning input star 4. Since the transfer arrangement 8 is stationary and rigidly configured, the container 6 is moved, upon progressing rotation of the rotor 2 and of the input star 4, from the carrying pocket 5 of the input star 4 into the corresponding carrying pocket 5 of the rotor 2.

In other words, for the insertion of the containers 6, the containers are first pushed toward the transfer device 8 by the continuously rotating infeed starwheel 4. Because the transfer device 8 is stationary and immobile, as the carousel 2 and infeed starwheel 4 advance, the containers 6 are pushed out of the starwheel pockets 5 and into the corresponding receiving pockets 5 of the carousel 2.

In other words, as the infeed starwheel 4 rotates and advances the bottles toward the carousel 2, the infeed starwheel eventually comes into contact with the transfer device 8. The transfer device 8 is disposed at such an angle with respect to the infeed starwheel 4 that it allows the bottle to slide along the length of a transfer arm 7, eventually forcing the bottle into the receiving pockets 5 of the carousel 2.

The transfer device 8 comprises a transfer arm 7 which is fastened in a stationary position on the container handling machine or on its components or other components by means of a fastening device (not shown), i.e. so that it does not rotate with the carousel 2.

In another possible embodiment, the transfer arm 7 may be mounted in a stationary position on the starwheels 4 or carousels 2 of the container handling machine. In an alternate embodiment, the transfer arm 7 may be mounted on its own mounting device, separate from the starwheels 4, the carousels 2, or any other components of the container handling machine.

The transfer arm 7 is a single element that is constructed with a rigid material such as metal or plastic. The transfer arm 7 is rigid, that is, not able to bend or otherwise change shape so that it stays in a uniform, stationary position. Further, the transfer arm 7 comprises at least one part that is not moveable with respect to the other parts of the bottling machine.

By way of the particularly advantageous design of the present embodiment, the processing stations are disposed at the rotor 2, i.e., for example, rinsing heads, filling heads, or, as well, the closing heads are not disposed—as is hitherto customary—on the reference diameter that is passing through the imaginary contact point of input star 4 and rotor 2, but on its own reference diameter that is pronouncedly smaller.

In other words, in one possible embodiment the processing stations are not located on the perimeter edge of the rotor 2 since almost the entire neck and head of each of the bottles 6 are located in the carrier pocket 5 inside the perimeter edge of the rotor 2, which defines a reference circle. The bottles 6 are not centered on the reference circle of the rotor 2, but rather are centered a distance from the reference circle in the carrying pockets 5 of the rotor 2. Therefore, the filling, capping, or rinsing devices are located above or about the bottles a distance from the reference circle on the rotor. In contrast, in the prior art shown in FIG. 1, half of the bottle neck is held in the pocket of the rotor, which results in the center of the bottle lying on the reference circle of the rotor, which reference circle defines an intersection or transfer point in conjunction with the reference circle of the input star wheel. The filling, capping, or rinsing devices are therefore located on the reference circle of the rotor in the prior art.

The reduction of the reference diameter of the processing stations that is attained amounts to approximately 2*½ of the diameter of the container.

This means that enclosures required, as a rule, in cold or aseptic container handling machines can be configured to be smaller, while otherwise leaving dimensions essentially unchanged, this providing the benefit that the required volume of sterile air and the costs associated with maintaining a sterile environment during the operation of such an installation can be further reduced.

In a further embodiment it is provided that the carrying pockets 5 are configured to be rounded in such a way that the outermost point of the neck rings 10 of the containers carried by the rotor 2 or stars forms a point of the imaginary circumferential circle of stars or rotor 2, or also extends by a few 1/10 millimeters or also by a few ½ millimeters beyond this imaginary circumferential circle.

The advantage of such a configuration resides in a possible further reduction of the reference diameter of the processing stations, with—due to the changed geometrical conditions—a higher consumption of sterile air, however, when compared with the prior art this sterile air consumption is still less than the prior art consumption.

Figure 4:
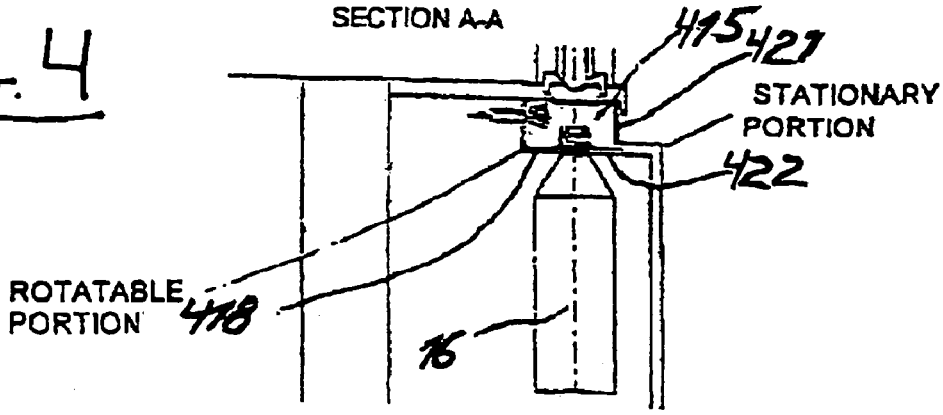
FIG. 4 is a detail illustration of an embodiment of the housing in the region of the filling machine, along line A—A in FIG. 6.

In accordance with another possible embodiment that is illustrated in FIG. 4, the clean chamber comprises a chamber, or a space, or a room 415 that surrounds only a portion of the beverage containers 16, namely, at least the mouth portions 417 thereof. In other words, chamber 415 is generally configured by rotatable portions or components 418 and by stationary portions or components 421. In this, the holders, supports and centering arrangements or centering devices 419 for the bottle mouths 417 are possibly directly disposed at the lower horizontal wall surface 418 that is rotating with the machine carousel. Such elements 419, accordingly, can comprise simple semicircular openings. On the other hand, other embodiments can be provided for the respective purpose. Thus, it is within the scope of the application that at the rotating wall of the chamber there are provided specially configured support fingers, or clamping fingers, and the like that can be accessed in the input regions and in the output regions for holding and for transferring. The outwardly directed centering of the circulating containers, or, respectively, the mouth portions thereof, is assuredly provided by a stationary chamber portion 420. This chamber portion 420 is practically configured rectangularly and it possibly forms a vertically projecting outer wall 421 and the inwardly directed centering wall 422 that can also be provided with a seal for sealing the annular gap. For enhancing cleaning, the centering wall 422 can also be disposed somewhat slopingly. The input region and the output region of such a filling machine are possibly formed by rotating stars.

Figure 4A:
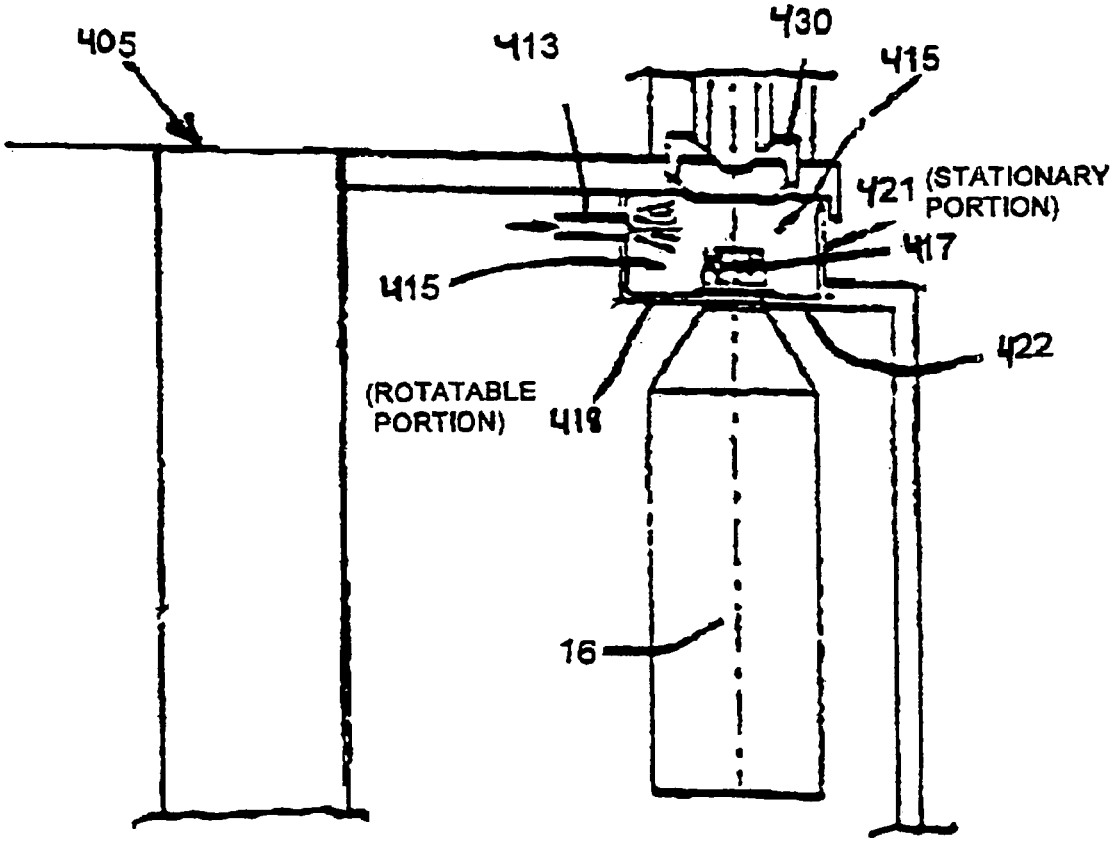
FIG. 4A is a view similar to FIG. 4 drawn to a larger scale and including identification of further detail.

FIG. 4A is a view similar to FIG. 4, but drawn to a larger scale and additionally showing a filling valve 430.

FIG. 4B illustrates in particular detail a seal arrangement 440 between surface 5*a* of a portion of filling machine 405 and surface 421*a* of stationary wall portion 421*b*. There may be provided similar seal arrangements 442 and 444 between the projecting portion of centering wall 422 and the groove 421*c* of the stationary wall 421. The centering wall 422 may comprise a slot, or slots, or similar openings 446 that may be covered by a cover, or covers, 448. Such covers 448 may possibly be actuated by cam arrangements configured and disposed to move the covers 448 to cover and uncover the slots or openings 446. Seals may be superfluous in at least one embodiment in which the disinfecting medium is introduced into chamber 415 with sufficient pressure to prevent ingress of microorganisms.

The conduit 413 is introduced, in one embodiment, through a vertical wall 418*a* that is part of the filling machine 405.

Figure 5:
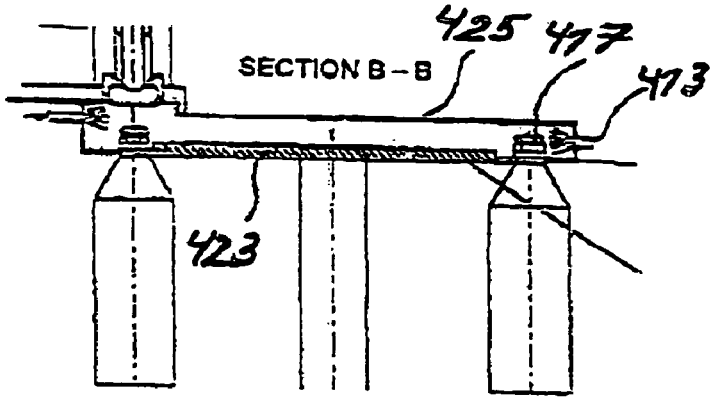
FIG. 5 is a cross-section along line B—B in FIG. 6.
Figure 5A:
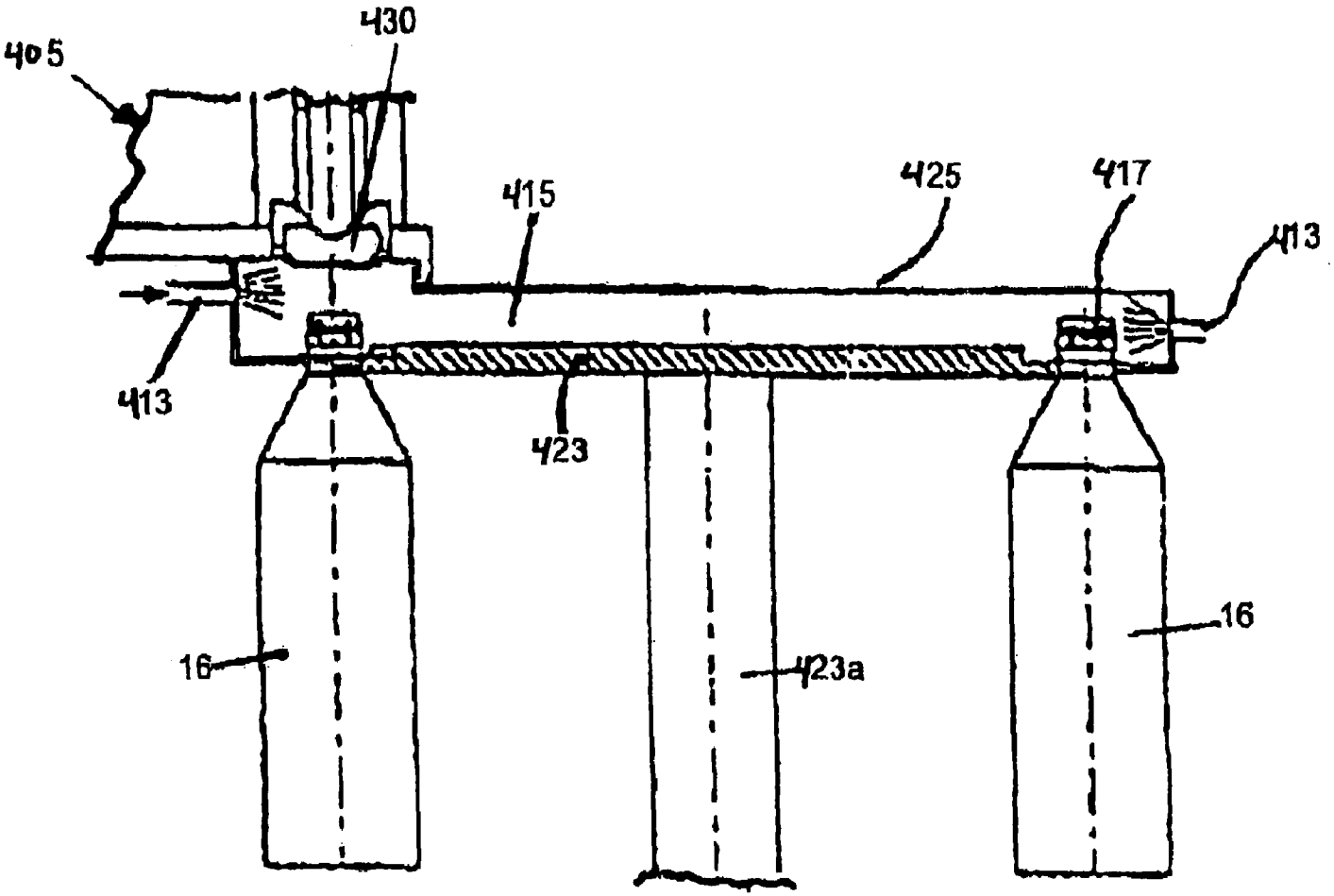
FIG. 5A is a view similar to FIG. 5 drawn to a larger scale and including identification of further detail.

In FIG. 5A, the flat disc 423 is shown to be rotatably disposed by means of a shaft 423*a*. FIG. 5A also indicates a filling valve 430, as is known in the art.

Figure 6:
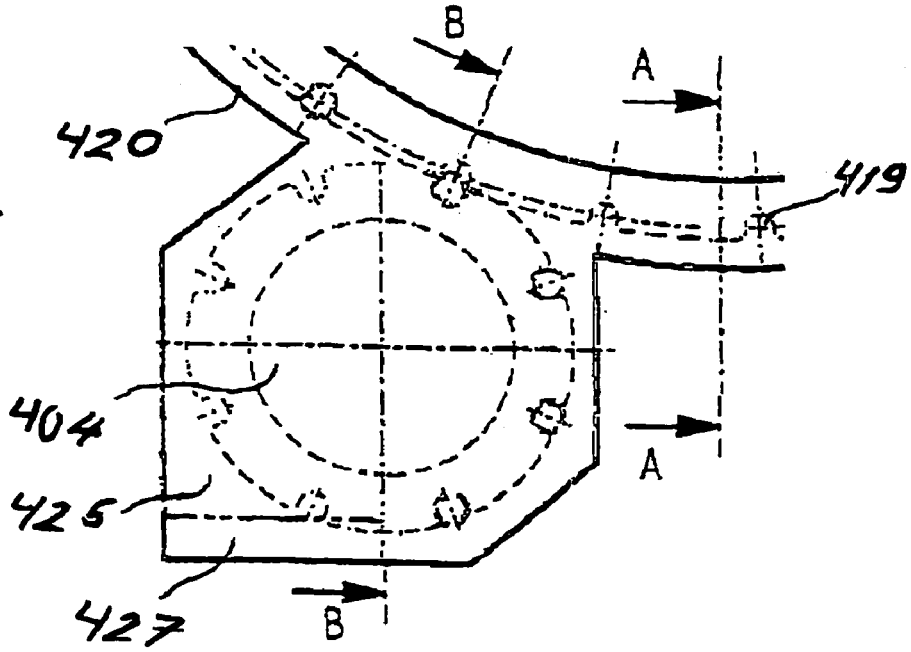
FIG. 6 is a top plan view of the enclosed region of an input star conveyer to feed bottles to the filling machine.

In accordance with the embodiment of FIG. 5 and FIG. 6, the stars are provided by a flat disc 423 with corresponding recesses, supports, and/or centering structures 424. These discs are enveloped by a stationary upper hood component 425 whereby the rotating disc surface provides the lower limit of the chamber. For introduction and removal of the mouth in the transfer region of the filling machine 405, and the like equipment, there can be provided transfer devices, cover sheets 426, and the like transfer elements, or arrangements to move bottle from the star wheel recess 424 to the filling machine recess 419, as is illustrated by way of an input embodiment in FIG. 6.

The container mouths are possibly introduced at a narrow entrance opening and exit opening 427 of the star pockets, or, respectively, the centering devices 424, or, respectively, removed from these upon completion of processing. For introduction of the sterile medium, inlets, or nozzles 413 can be provided at various locations, so as to maintain a rather constant and a rather all-pervasive low over-pressure in the clean chamber 415. However, it is within the scope of the various embodiments to carry out the introduction of the sterile medium at the container input side, whereby this sterile medium, or, respectively, a portion thereof, flows through the clean chamber 415 in the direction of rotation of the equipment while utilizing the rotational flow.

Figure 7A:
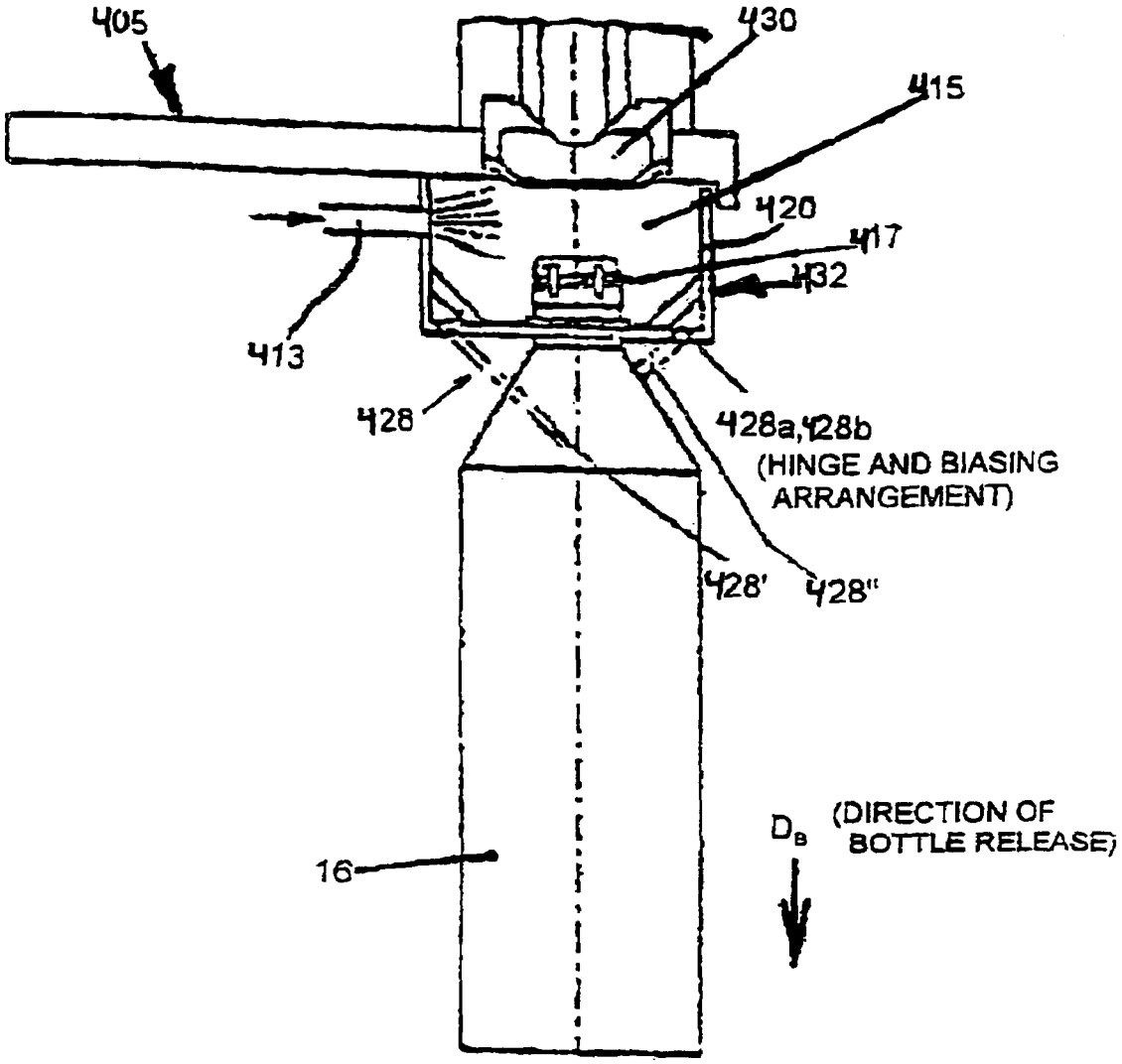
FIG. 7A is a view similar to FIG. 7 drawn to a larger scale and including identification of further detail.

In accordance with another possible embodiment illustrated in FIG. 6, the supports, and/or the centering devices 424 that carry the mouths 417, or, respectively, the regions thereof, can be hingedly disposed, for example, to be swung in outward direction, or in downward direction. For this, the corresponding hinge mechanism 425 can be held with torsion springs 427 at rotary hinges 426. In other words, FIG. 7A suggests a hinge 428*a*, as is well known, and a biasing element, such as, a spring 428*b*, as is well known for spring-biased hinge arrangements, for example, a torsion spring, forming part of a release mechanism or arrangement 428 having components 428' and 428" for bottles 16 that may need to be removed in downward direction $D_B$ upon a operating and/or system failure in the filling process. There may also be provided a stop arrangement 432.

Figure 7B:
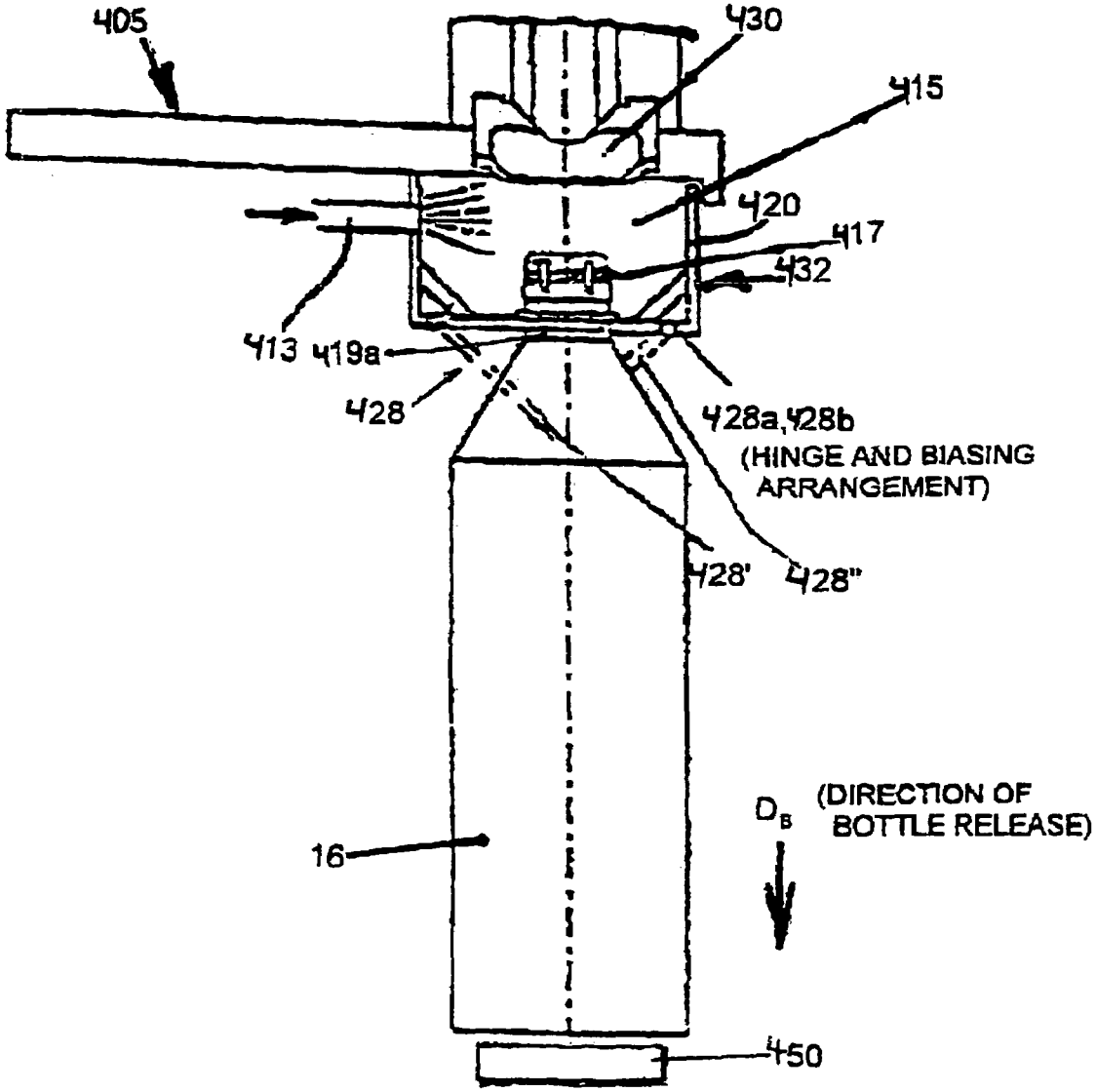
FIG. 7B is a view similar to FIG. 7 and including identification of further detail.

In the case where the containers 16 are introduced from below in upward direction in the manner as is done in known filling machines that employ lifting elements, there are possibly provided openings at the lower side of the clean chamber. Movement of a bottle 16 into the corresponding opening may be with play or without play. Flexible openings or retainers 419*a* and a lifting device 450 are illustrated in FIG. 7B of this application. In this way, the mouth portion 417 of a bottle 16 is introduced from below into the clean chamber 415 and is then surrounded in the chamber 415 by a disinfecting medium.

The bottles 16 may be introduced by lifting devices 450 which are well known in the art, from below into the clean room or chamber 415.

In other words, a container filling machine 405 may possibly of a design of a rotating machine that has a plurality of filling elements or filling valves 430 the rotor 105'. Support plates or support tables that can be raised and lowered at the filling positions 113 are associated with the filling elements or valves 430, which support tables, for example carriers, receive the containers 16 that are to be filled via input star wheels, for example transport star 404.

Further, a lifting device such as 450, that also lowers a container 16, is associated with each of these support tables, has the purpose of raising the containers 16 that are disposed on the support tables or carriers towards the filling devices or valves 430 and to press the containers 16 against the filling valves 430. In order to accomplish this function, these lifting devices may possibly comprise a combination of a fixed piston and a moveably disposed cylinder structure that surrounds the piston. The structural components are disposed vertically, and with the piston being rigidly connected to the rotor of the container filling machine 405. The cylinder can be moved up and down in a vertical direction. The cylinder chamber or cavity that is established between the fixed piston and the moveable cylinder, is in most cases operated by compressed air, the compressed air being passed through a bore within the piston, such that the cylinder is moved in a vertical direction to an upper position. This movement may possibly be limited by a roller that is secured to the cylinder, which roller is configured to rotate about its longitudinal axis, with the roller contacting a curved stationary cam structure. By way of the rotating movement of the rotor of the container filling machine, the roller rolls upon the curved path of the cam structure, that is, it follows the course of the curved cam structure and simultaneously carries out an upwardly directed movement and a corresponding downwardly directed movement, which movements, due to the configuration of the design of the machine 405, are also carried out by the support table and, accordingly, a container 16 supported on a support table.

The curved path of such cam structures is not disposed along the entire circumferential surface area or region of the rotor 105', but they rather extend only along a portion of the circumference, possibly in the region of the container inlet and the container outlet, where the receiving surface of the support table 113*a* needs to be disposed at the level of the transport structures that supply containers 16 and also remove containers 16.

One feature or aspect of an embodiment is believed at the time of the filing of this patent application to possibly reside broadly in a container handling machine such as filler, rinser, or closer for the processing of containers that comprise a neck ring, said machine comprising a rotating rotor at which are disposed processing stations for the containers, with at least one input star, with at least one output star and/or at least one transfer star, with carrying pockets that are disposed at the rotor and/or the stars characterized in that the processing stations are disposed on a reference diameter that is smaller than the rotor related reference diameter of the transfer point of the container between rotor and input star and/or output star and/or transfer star.

Another feature or aspect of an embodiment is believed at the time of the filing of this patent application to possibly reside broadly in a container handling machine, characterized in that the carrying pockets are configured in such a way that they fully carry the container neck.

Yet another feature or aspect of an embodiment is believed at the time of the filing of this patent application to possibly reside broadly in a container handling machine, characterized in that the carrying pockets are configured in such a way that they substantially fully carry the container neck.

Still another feature or aspect of an embodiment is believed at the time of the filing of this patent application to possibly reside broadly in a container handling machine, characterized in that the carrying pockets are configured in such a way that they fully carry the neck ring.

A further feature or aspect of an embodiment is believed at the time of the filing of this patent application to possibly reside broadly in a container handling machine, characterized in that the carrying pockets are configured in such a way that they substantially fully carry the neck ring.

Another feature or aspect of an embodiment is believed at the time of the filing of this patent application to possibly reside broadly in a container holding machine, characterized in that at the container handling machine and/or the associated stars there are disposed outer guide arrangements.

Yet another feature or aspect of an embodiment is believed at the time of the filing of this patent application to possibly reside broadly in a container handling machine, characterized in that the width of the gap between the outer guide arrangement and the rotor and/or stars is only a few 1/10 millimeters in size.

Still another feature or aspect of an embodiment is believed at the time of the filing of this patent application to possibly reside broadly in a container handling machine, characterized in that the width of the gap between the outer guide arrangement and rotor and/or stars is only a few ½ millimeters in size.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and No. 6,025 issued to Yasui on Feb. 15, 2000.

The corresponding foreign and international patent publication applications, namely, Federal Republic of Germany Patent Application No. 103 47 540.0, filed on Oct. 10, 2003, having inventors Stefan Wagner, Stephan Willemsen, Bernd Cox, and Manfred van Triel, and DE-OS 103 47 540.0 and DE-PS 103 47 540.0, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

In the event that automatic tool changes would be desirable in a possible embodiment, some examples of automatic tool changer apparatuses which may possibly be utilized or adapted for use in at least one possible embodiment may possibly be found in the following U.S. Pat. No. 5,300,006, entitled "Automatic tool changer;" U.S. Pat. No. 4,835,838, entitled "Automatic tool changer in machine tool;" U.S. Pat. No. 4,799,308, entitled "Automatic tool changer;" U.S. Pat. No. 4,773,152, entitled "Automatic tool changer;" U.S. Pat. No. 4,764,064, entitled "Tool changer;" U.S. Pat. No. 4,696,091, entitled "Automatic tool changer;" U.S. Pat. No. 4,614,137, entitled "Magnetic tool changer;" U.S. Pat. No. 4,610,074, entitled "Automatic tool changer of a machine tool;" U.S. Pat. No. 4,601,094, entitled "Turning machine with an automatic tool changer;" U.S. Pat. No. 4,499,650, entitled "Automatic tool changer;" U.S. Pat. No. 4,467,517, entitled "Tool changer for facing head;" U.S. Pat. No. 4,387,502, entitled "Semi-automatic tool changer;" and U.S. Pat. No. 4,329,770, entitled "Automatic tool changer."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottling systems which may possibly be utilized or adapted for use in at least one possible embodiment may possibly be found in the following U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled" Labeling machine and method; U.S. Pat. No. 6,050,319, entitled "Non-round container labeling machine and method;" and U.S. Pat. No. 6,045,616, entitled "Adhesive station and labeling machine."

The details in the patents, patent applications and publications may be considered to be incorporable, at applicant's option, into the claims during prosecution as further limitations in the claims to patentably distinguish any amended claims from any applied prior art.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of centering devices for bottle handling devices which may possibly be utilized or adapted for use in at least one possible embodiment may possibly be found in Federal Republic of Germany Application No. DE P 103 14 634, entitled "Spulbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

U.S. application Ser. No. 10/939,170, filed on Sep. 10, 2004, having inventor Volker TILL and attorney docket no. NHL-HOL-83, is hereby incorporated by reference as if set forth in its entirety herein.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments described herein above in the context of the preferred embodiments are not to be taken as limiting the embodiments to all of the provided details thereof, since modifications and variations thereof may be made without departing from the spirit and scope of the embodiments.

What is claimed is:

1. A container handling machine (1) such as filler, rinser, or closer for the processing of containers that comprise a neck ring, said machine comprising a bottle processing device with a processing device rotatable carousel and processing stations for the containers (6), with at least one input star (4), with at least one output star and/or at least one transfer star, with a plurality of carrying pockets disposed at the rotatable carousel and/or the stars wherein each of the stars is disposed on a reference diameter that is smaller than the rotatable carousel related reference diameter of a transfer point of the container (6) between the rotatable carousel and the input star and/or the output star (4) and/or the transfer star;

said processing device rotatable carousel comprising a plurality of carrying pockets to hold neck portions of bottles which neck portion is disposed adjacent and below the neck ring of the bottles in its said processing device;

said processing device rotatable carousel further comprising processing device circular portions being disposed between said carrying pockets which circular portions separate said carrying pockets from one another;

said processing device circular portions disposed about said processing device rotatable carousel comprising a diameter across said processing device rotatable carousel;

said carrying pockets being sufficiently deep such that the outermost neck portions of the bottles disposed adjacent and below the neck ring of the bottles contained in the pockets are supported by the neck portion of the bottles, which outermost neck portions adjacent and below which the neck ring of the bottles are disposed are at a diameter being substantially equal to said diameter of said processing device circular portions of said processing device rotatable carousel;

a processing device outer guide arrangement comprising a first portion configured to move the bottles fed into said processing device rotatable carousel from the input star delivering bottles to said processing device and into said pockets on said processing device rotatable carousel and a second processing device portion configured to guide the bottles around said processing device rotatable carousel;

said processing device second portion of said processing device outer guide arrangement being disposed about said processing device rotatable carousel; and said second portion of said processing device outer guide arrangement having an inner diameter being substantially equal to said diameter of said processing device circular portions to form a gap between said inner portion of said second portion of said processing device outer guide arrangement and said processing device circular portions of said processing device carousel to minimize said gap between said processing device outer guide arrangement and said processing device circular portions.

2. The container handling machine according to claim 1, wherein the carrying pockets (5) are configured in such a way that they fully carry the container neck.

3. The container handling machine according to claim 1, wherein the carrying pockets (5) are configured in such a way that they substantially fully carry the container neck.

4. The container handling machine according to claim 3, wherein the carrying pockets (5) are configured in such a way that they substantially fully carry the neck ring (10).

5. The container handling machine according to claim 4, wherein at the container handling machine and/or the associated stars there are disposed outer guide arrangements (7).

6. The container handling machine according to claim 5, wherein the width of the gap between the outer guide arrangement (7) and the rotor (2) and/or stars is only a few 1/10 millimeters in size.

7. The container handling machine according to claim 1, wherein the carrying pockets (5) are configured in such a way that they fully carry the neck ring (10).

8. The container handling machine according to claim 1, wherein the width of the gap between the outer guide arrangement (7) and rotor (2) and/or stars is only a few ½ millimeters in size.

9. A beverage bottling plant for aseptically filling bottles with neck rings with a sterile liquid beverage filling material, said beverage bottling plant comprising:

a bottle cleaning machine being configured and disposed to clean empty bottles;

said bottle cleaning machine comprising:

a bottle cleaning machine device being configured with a structure to contain a sterile gas around the cleaned bottles and disposed to provide an aseptic environment in said bottle cleaning machine chamber; and a plurality of bottle cleaning devices for cleaning bottles;

a feed arrangement to supply empty bottles to said bottle cleaning machine;

a beverage filling machine being configured and disposed to aseptically fill empty bottles with liquid beverage filling material;

said beverage filling machine comprising:

a rotatable carousel comprising a plurality of carrying pockets to hold the tops of bottles in said beverage filling machine;

a beverage filling machine chamber being configured with a structure to contain a sterile gas around the cleaned bottles and disposed to confine at least the top of each bottle being filled;

a beverage filling machine device being configured with a structure to contain a sterile gas around the cleaned bottles and disposed to provide an aseptic environment in said beverage filling machine chamber to aseptically contain at least a portion of the bottles being processed; and a plurality of beverage filling devices for filling bottles with liquid beverage filling material;

a first conveyer arrangement being configured and disposed to move empty bottles from said bottle cleaning machine into said beverage filling machine;

said first conveyer arrangement comprising:

a first star wheel structure configured to move bottles from said cleaning machine to said filling machine and to hold at least the portion of the tops of the bottles adjacent and below the neck rings on the tops of bottles;

said star wheel structure comprising a plurality of carrying pockets to hold the tops of bottles;

a first conveyer arrangement chamber being configured and disposed to aseptically confine at least the top of each bottle; and a first conveyer arrangement device being configured with a structure to contain a sterile gas around the cleaned bottles and disposed to provide an aseptic environment in said first conveyer arrangement chamber to aseptically contain at least the tops of the bottles being processed;

a rotatable bottle closing machine being configured with a structure to contain a sterile gas around the cleaned bottles and disposed to close tops of filled bottles;

said bottle closing machine comprising:

a rotatable carousel comprising a plurality of carrying pockets to hold at least the portion of the bottles adjacent and below the neck rings on the tops of bottles in said beverage filling machine;

a bottle closing machine chamber portion being configured and disposed to confine at least the top of each bottle being processed to provide an aseptic environment;

a bottle closing machine device being configured and disposed to provide an aseptic environment in said bottle closing machine chamber to aseptically contain at least the tops of the bottles being processed; and a plurality of bottle closing devices for closing bottles;

a second conveyer arrangement being configured and disposed to move filled bottles aseptically from said rotatable beverage filling machine into said bottle closing machine;

said second conveyer arrangement comprising:

a star wheel structure configured to hold the tops of bottles by their neck rings;

said star wheel structure comprising a plurality of carrying pockets to hold the tops of bottles;

a second conveyer arrangement chamber being configured and disposed to aseptically confine at least the top of each bottle being processed; and a second conveyer arrangement device being configured with a structure to contain a sterile gas around the cleaned bottles and disposed to provide an aseptic environment in said second conveyer arrangement chamber to aseptically contain at least the tops of the bottles being processed;

a packaging station being configured to package a plurality of closed, filled bottles into single containers;

a third conveyer arrangement being configured and disposed to move filled bottles from said bottle closing machine to said packaging station;

each of said bottle cleaning devices, said beverage filling devices, and said bottle closing devices comprise a bottle processing device; and at least one of said processing devices comprising its said processing device rotatable carousel;

each said processing device rotatable carousel comprising a plurality of carrying pockets to hold neck portions of bottles which neck portion is disposed adjacent and below the neck ring of the bottles in its said processing device;

each said processing device rotatable carousel further comprising processing device circular portions being disposed between said carrying pockets which circular portions separate said carrying pockets from one another;

said processing device circular portions disposed about said processing device rotatable carousel comprising a diameter across said processing device rotatable carousel;

said carrying pockets being sufficiently deep such that the outermost neck portion of the bottles disposed adjacent and below the neck ring of the bottles contained in the pockets are supported by the neck portion of the bottles, which outermost neck portions adjacent and below the neck ring of the bottles disposed are at a diameter being substantially equal to said diameter of said processing device circular portions of said processing device rotatable carousel;

a processing device outer guide arrangement comprising a first portion configured to move the bottles fed into said processing device rotatable carousel from a respective conveyer arrangement device delivering bottles to said processing device and into said pockets on said processing device rotatable carousel and a second processing device portion configured to guide the bottles around said processing device rotatable carousel;

said processing device second portion of said processing device outer guide arrangement being disposed about said processing device rotatable carousel; and said second portion of said processing device outer guide arrangement having an inner diameter being substantially equal to said diameter of said processing device circular portions to form a gap between said inner portion of said second portion of said processing device outer guide arrangement and said processing device circular portions of said processing device carousel to minimize said gap between said processing device outer guide arrangement and said processing device circular portions and thus to minimize consumption of sterile air by said processing device.

10. The beverage bottling plant according to claim 9, wherein the carrying pockets (5) are configured in such a way that they fully carry the container neck.

11. The beverage bottling plant according to claim 9, wherein the carrying pockets (5) are configured in such a way that they substantially fully carry the container neck.

12. The beverage bottling plant according to claim 11, wherein the carrying pockets (5) are configured in such a way that they substantially fully carry the neck ring (10).

13. The beverage bottling plant according to claim 12, wherein at the beverage bottling plant and/or the associated rotatable carousels there are disposed outer guide arrangements (7).

14. The beverage bottling plant according to claim 13, wherein the width of the gap between the outer guide arrangement (7) and the rotor (2) and/or stars is only a few 1/10 millimeters in size.

15. The beverage bottling plant according to claim 9, wherein the carrying pockets (5) are configured in such a way that they fully carry the neck ring (10).

16. The beverage bottling plant according to claim 9, wherein the width of the gap between the outer guide arrangement (7) and rotor (2) and/or stars is only a few ½ millimeters in size.

17. A beverage bottling plant for filling bottles with a liquid beverage filling material, said beverage bottling plant comprising:

a bottle cleaning machine being configured and disposed to clean empty bottles;

said bottle cleaning machine comprising:

a rotatable carousel comprising a plurality of carrying pockets to hold the tops of bottles in said bottle cleaning machine;

a bottle cleaning machine chamber being configured and disposed to confine the top of each bottle being processed and also being configured to dispose the lower portion of each bottle, having its top confined, outside said bottle cleaning machine chamber;

a bottle cleaning machine device being configured and disposed to provide an anaerobic environment in said bottle cleaning machine chamber to anaerobically contain solely the tops of the bottles being processed; and a plurality of bottle cleaning devices for cleaning bottles;

a feed arrangement to supply empty bottles to said bottle cleaning machine comprising a starwheel;

a beverage filling machine being configured and disposed to fill empty bottles with liquid beverage filling material;

said beverage filling machine comprising:

a rotatable carousel comprising a plurality of carrying pockets to hold the tops of bottles in said beverage filling machine;

a beverage filling machine chamber being configured and disposed to confine the top of each bottle being processed and also being configured to dispose the lower portion of each bottle, having its top confined, outside said beverage filling machine chamber;

a beverage filling machine device being configured and disposed to provide an anaerobic environment in said beverage filling machine chamber to anaerobically contain solely the tops of the bottles being processed; and a plurality of beverage filling devices for filling bottles with liquid beverage filling material;

a first conveyer arrangement being configured and disposed to move empty bottles from said bottle cleaning machine into said beverage filling machine;

said first conveyer arrangement comprising:

a star wheel structure configured to hold the tops of bottles;

said star wheel structure comprising a plurality of carrying pockets to hold the tops of bottles;

a first conveyer arrangement chamber being configured and disposed to confine the top of each bottle being processed and also being configured to dispose the lower portion of each bottle, having its top confined, outside said first conveyer arrangement chamber; and a first conveyer arrangement device being configured and disposed to provide an anaerobic environment in said first conveyer arrangement chamber to anaerobically contain solely the tops of the bottles being processed;

a rotatable bottle closing machine being configured and disposed to close tops of filled bottles;

said bottle closing machine comprising:

a rotatable carousel comprising a plurality of carrying pockets to hold the tops of bottles in said beverage filling machine;

a bottle closing machine chamber being configured and disposed to confine the top of each bottle being processed and also being configured to dispose the lower portion of each bottle, having its top confined, outside said beverage filling machine chamber;

a bottle closing machine device being configured and disposed to provide an anaerobic environment in said bottle closing machine chamber to anaerobically contain solely the tops of the bottles being processed; and a plurality of bottle closing devices for closing bottles;

a second conveyer arrangement being configured and disposed to move filled bottles from said rotatable beverage filling machine into said bottle closing machine;

said second conveyer arrangement comprising:

a star wheel structure configured to hold the tops of bottles;

said star wheel structure comprising a plurality of carrying pockets to hold the tops of bottles;

a second conveyer arrangement chamber being configured and disposed to confine the top of each bottle being processed and also being configured to dispose the lower portion of each bottle, having its top confined, outside said second conveyer arrangement chamber; and a second conveyer arrangement device being configured and disposed to provide an anaerobic environment in said second conveyer arrangement chamber to anaerobically contain solely the tops of the bottles being processed;

a packaging station being configured to package a plurality of closed, filled bottles into single containers;

a third conveyer arrangement being configured and disposed to move filled bottles from said bottle closing machine to said packaging station;

said bottle cleaning devices, said beverage filling devices, and said bottle closing devices comprise bottle processing devices; and each of said bottle cleaning devices, said beverage filling devices, and said bottle closing devices comprise a bottle processing device; and at least one of said processing devices comprising its said processing device rotatable carousel;

each said processing device rotatable carousel comprising a plurality of carrying pockets to hold neck portions of bottles which neck portion is disposed adjacent and below the neck ring of the bottles in its said processing device;

each said processing device rotatable carousel further comprising processing device circular portions being disposed between said carrying pockets which circular portions separate said carrying pockets from one another;

said processing device circular portions disposed about said processing device rotatable carousel comprising a diameter across said processing device rotatable carousel;

said carrying pockets being sufficiently deep such that the outermost neck portion of the bottles disposed adjacent and below the neck ring of the bottles contained in the pockets are supported by the neck portion of the bottles, which outermost neck portions adjacent and below the neck ring of the bottles disposed are at a diameter being substantially equal to said diameter of said processing device circular portions of said processing device rotatable carousel;

a processing device outer guide arrangement comprising a first portion configured to move the bottles fed into said processing device rotatable carousel from a respective starwheel delivering bottles to said processing device and into said pockets on said processing device rotatable carousel and a second processing device portion configured to guide the bottles around said processing device rotatable carousel said processing device second portion of said processing device outer guide arrangement being disposed about said processing device rotatable carousel; and said second portion of said processing device outer guide arrangement having an inner diameter being substantially equal to said diameter of said processing device circular portions to form a gap between said inner portion of said second portion of said processing device outer guide arrangement and said processing device circular portions of said processing device carousel to minimize said gap between said processing device outer guide arrangement and said processing device circular portions and thus to minimize consumption of sterile air or inert gas by said processing device.

18. The beverage bottling plant according to claim 17, wherein the carrying pockets (5) are configured in such a way that they fully carry the container neck.

19. The beverage bottling plant according to claim 17, wherein the carrying pockets (5) are configured in such a way that they substantially fully carry the container neck.

20. The beverage bottling plant according to claim 17, wherein the carrying pockets (5) are configured in such a way that they fully carry the neck ring (10).

* * * * *